US011541505B2

(12) United States Patent
Wang et al.

(10) Patent No.: US 11,541,505 B2
(45) Date of Patent: Jan. 3, 2023

(54) POLISHING PAD, MANUFACTURING METHOD OF POLISHING PAD AND POLISHING METHOD

(71) Applicant: IV Technologies CO., Ltd., Taichung (TW)

(72) Inventors: Yu-Piao Wang, Hsinchu County (TW); I-Ping Chen, Tainan (TW)

(73) Assignee: IV Technologies CO., Ltd., Taichung (TW)

( * ) Notice: Subject to any disclaimer, the term of this patent is extended or adjusted under 35 U.S.C. 154(b) by 805 days.

(21) Appl. No.: 16/387,494

(22) Filed: Apr. 17, 2019

(65) Prior Publication Data

US 2019/0321936 A1 Oct. 24, 2019

(30) Foreign Application Priority Data

Apr. 19, 2018 (TW) ..... 107113416

(51) Int. Cl.
*B24B 37/22* (2012.01)
*B24D 11/00* (2006.01)
*B24B 37/24* (2012.01)

(52) U.S. Cl.
CPC ..... *B24B 37/22* (2013.01); *B24D 11/001* (2013.01); *B24D 11/008* (2013.01); *B24B 37/24* (2013.01)

(58) Field of Classification Search
CPC ..... B24B 37/20; B24B 37/22; B24B 37/24; B24B 37/245; B24B 37/26; B24D 11/001; B24D 11/008; B24D 13/147; B24D 18/00; B24D 3/004; B24D 3/28; B24D 3/346; B24D 11/02; B24D 18/0045
USPC ..... 451/259, 539, 260; 51/297
See application file for complete search history.

(56) References Cited

U.S. PATENT DOCUMENTS 6,537,144 B1 * 3/2003 Tsai ..... B24B 37/26 451/526
7,901,272 B2 * 3/2011 Sung ..... B24D 18/0009 451/443
2006/0094338 A1 * 5/2006 Kim ..... B24B 49/14 451/7

(Continued)

FOREIGN PATENT DOCUMENTS

CN 1706594 12/2005
CN 207075163 3/2018

(Continued)

OTHER PUBLICATIONS

"Office Action of China Counterpart Application", dated Mar. 20, 2020, p. 1-p. 9.

*Primary Examiner* — Joseph J Hail
*Assistant Examiner* — Arman Milanian
(74) *Attorney, Agent, or Firm* — JCIPRNET

(57) ABSTRACT

A polishing pad is provided. The polishing pad comprises a polishing layer and a metal-containing layer. The polishing layer has a polishing surface and a backside surface opposite to each other, wherein the backside surface has a plurality of cavities. The metal-containing layer is disposed on the backside surface of the polishing layer and fills into the cavities, wherein a first contact area is between the metal-containing layer and the backside surface of the polishing layer, and the first contact area is larger than the orthogonal projection area of the polishing layer.

18 Claims, 2 Drawing Sheets

(56) References Cited

U.S. PATENT DOCUMENTS

| | | | | |
|---|---|---|---|---|
| 2013/0295821 | A1* | 11/2013 | Lugg | B24B 37/245 451/526 |
| 2014/0308883 | A1* | 10/2014 | Sung | B24B 53/017 451/443 |

FOREIGN PATENT DOCUMENTS

| | | |
|---|---|---|
| JP | 2004017168 | 1/2004 |
| JP | 2012020349 | 2/2012 |

* cited by examiner

POLISHING PAD, MANUFACTURING METHOD OF POLISHING PAD AND POLISHING METHOD

CROSS-REFERENCE TO RELATED APPLICATION

This application claims the priority benefit of Taiwan application serial no. 107113416, filed on Apr. 19, 2018. The entirety of the above-mentioned patent application is hereby incorporated by reference herein and made a part of this specification.

BACKGROUND

Technical Field

The present invention relates to a polishing pad, a method of manufacturing the polishing pad, and a polishing method, and more particularly to a polishing pad whose temperature can be lowered during a polishing process, a method of manufacturing the same, and a polishing method using the same.

Description of Related Art

In the manufacturing process of industrial devices, the polishing process is currently the more commonly used technique to planarize the surface of an object to be polished. During the polishing process, relative motion occurs to the object and the polishing surface of the polishing layer of the polishing pad, and a polishing fluid is provided between the object surface and the polishing surface to perform polishing. During the polishing process, the polishing pad generates heat due to friction. Because the heat dissipation efficiency of the conventional polishing pad is poor, the temperature of the conventional polishing pad during the polishing process would rise up too much, thereby affecting the stability of the polishing process.

Therefore, there is still a need to provide means for reducing the temperature of the polishing pad during the polishing process for the industry to choose.

SUMMARY

The present invention provides a polishing pad, a method of manufacturing the same, and a polishing method such that the temperature of the polishing pad can be decreased during the polishing process.

The polishing pad of the present invention comprises a polishing layer and a metal-containing layer. The polishing layer has a polishing surface and a backside surface opposite to each other, wherein the backside surface has a plurality of cavities. The metal-containing layer is disposed on the backside surface of the polishing layer and fills into the plurality of cavities, wherein a first contact area is between the metal-containing layer and the backside surface of the polishing layer, and the first contact area is larger than the orthogonal projection area of the polishing layer.

The method of manufacturing the polishing pad of the present invention comprises the following steps. A polishing layer having a polishing surface and a backside surface opposite to each other is provided, wherein the backside surface has a plurality of cavities. A metal-containing layer is formed on the backside surface of the polishing layer and fills into the plurality of cavities, wherein a first contact area is between the metal-containing layer and the backside surface of the polishing layer, and the first contact area is larger than the orthogonal projection area of the polishing layer.

The polishing method of the present invention is suitable for polishing an object and includes the following steps. A polishing pad is provided, wherein the polishing pad is any one of the polishing pads described above. Pressure is applied to the object to press the object onto the polishing pad. The object and the polishing pad are provided with relative motion to perform a polishing process.

Based on the above, in the polishing pad of the present invention or the polishing pad obtained by the method of manufacturing the polishing pad of the present invention, the backside surface of the polishing layer has the plurality of cavities, the metal-containing layer is disposed on the backside surface of the polishing layer and fills into the plurality of cavities, and the contact area between the metal-containing layer and the backside surface of the polishing layer is greater than the orthogonal projection area of the polishing layer, so that heat generated by the friction during the polishing process can be efficiently conducted to the external environment through the metal-containing layer, thereby reducing the accumulation of heat in the polishing pad. As a result, the degree of temperature rise of the polishing pad caused by the friction is lowered, thereby achieving the purpose of effectively decreasing the temperature of the polishing pad.

In order to make the aforementioned features and advantages of the disclosure more comprehensible, embodiments accompanied with figures are described in detail below.

DESCRIPTION OF THE EMBODIMENTS

The term "about," "approximately," "essentially" or "substantially" as used herein is inclusive of the stated value and means within an acceptable range of deviation for the particular value as determined by persons of ordinary skill in the art, considering the measurement in question and the error associated with measurement of the particular quantity (i.e., the limitations of the measurement system). For example, "about" may mean within one or more standard deviations, or within, for example, ±30%, ±20%, ±15%, ±10%, ±5% of the stated value. Moreover, a relatively acceptable range of deviation or standard deviation may be chosen for the term "about," "approximately," "essentially" or "substantially" as used herein based on optical properties, etching properties or other properties, instead of applying one standard deviation across all the properties.

Figure 1:
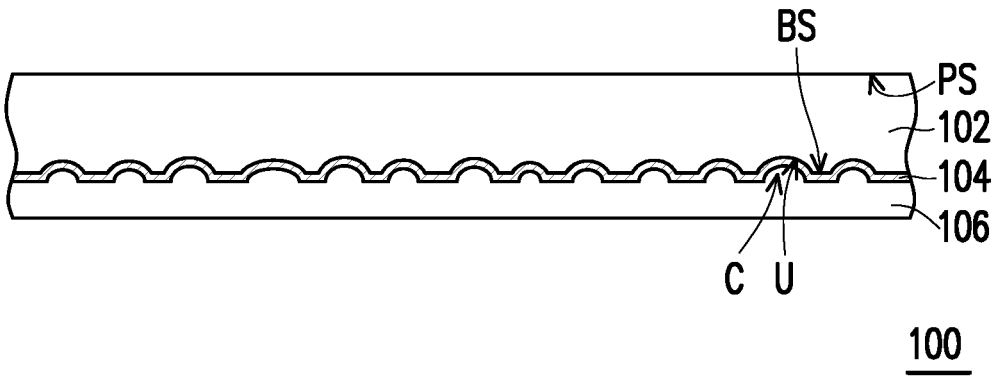
FIG. 1 is a schematic cross-sectional view of a polishing pad in accordance with an embodiment of the present invention.

FIG. 1 is a schematic cross-sectional view of a polishing pad in accordance with an embodiment of the present invention. Referring to FIG. 1, in the present embodiment, a polishing pad 100 includes a polishing layer 102 and a metal-containing layer 104. In addition, in the present embodiment, the polishing pad 100 may selectively include an adhesive layer 106.

In the present embodiment, the polishing layer 102 has a polishing surface PS and a backside surface BS opposite to the polishing surface PS. In the present embodiment, when the object is subjected to a polishing process using the polishing pad 100, the object comes into contact with the polishing surface PS of the polishing layer 102. As shown in FIG. 1, in the present embodiment, the backside surface BS of the polishing layer 102 has a plurality of cavities U. That is, in the present embodiment, the backside surface BS of the polishing layer 102 is a non-flat surface. In one embodiment, the polishing layer 102 may be a porous structure (e.g., a closed porous structure or an open porous structure), and then the plurality of cavities U may belong to part of the porous structure. However, the invention is not limited thereto. In another embodiment, the polishing layer 102 may be a non-porous structure, and then the plurality of cavities U may include knife marks, etch marks, laser marks or wear marks caused by applied force or energy. Herein, a non-porous structure is defined as a structure that has very few pores or even no pores.

In the present embodiment, the ratio of the cross-sectional area of the plurality of cavities U on the backside surface BS of the polishing layer 102 to the orthogonal projection area of the polishing layer 102 is greater than about 1% (e.g., greater than about 2%, 5%, 10%, 20%, 30%, 40%, or 50%, but the invention is not limited thereto). Further, in the present embodiment, since the backside surface BS of the polishing layer 102 has the plurality of cavities U, the area of the backside surface BS of the polishing layer 102 is larger than the orthogonal projection area of the polishing layer 102. In one embodiment, the area of the backside surface BS of the polishing layer 102 is greater than about 102% of the orthogonal projection area of the polishing layer 102 (e.g., greater than about 104%, 110%, 122%, 150%, 185%, 233%, or 300%, but the invention is not limited thereto). Herein, an orthogonal projection area is defined as a projection area perpendicular to the polishing surface PS of the polishing layer 102.

In the present embodiment, the polishing layer 102 is made of, for example, a polymer matrix, wherein the polymer matrix may be polyester, polyether, polyurethane, polycarbonate, polyacrylate, polybutadiene, or other polymer base material synthesized from suitable thermosetting resin or a suitable thermoplastic resin, but the invention is not limited thereto.

In the present embodiment, the metal-containing layer 104 is disposed on the backside surface BS of the polishing layer 102 and fills into the plurality of cavities U. That is, in the present embodiment, the backside surface BS of the polishing layer 102 is a surface where the polishing layer 102 is in contact with the metal-containing layer 104. As shown in FIG. 1, in the present embodiment, the metal-containing layer 104 conformally fills into the plurality of cavities U to form a plurality of recessed portions C. That is, in the present embodiment, the metal-containing layer 104 has a surface profile conforming to the contour of the backside surface BS of the polishing layer 102.

On the other hand, as described above, the backside surface BS of the polishing layer 102 is the surface of the polishing layer 102 in contact with the metal-containing layer 104 and the area of the backside surface BS of the polishing layer 102 is larger than the orthogonal projection area of the polishing layer 102, so in the present embodiment, the contact area between the metal-containing layer 104 and the backside surface BS of the polishing layer 102 is larger than the orthogonal projection area of the polishing layer 102. In one embodiment, the contact area between the metal-containing layer 104 and the backside surface BS of the polishing layer 102 is greater than about 102% of the orthogonal projection area of the polishing layer 102.

In the following Table 1, the ratios of the contact area between the metal-containing layer 104 and the backside surface BS of the polishing layer 102 to the orthogonal projection area of the polishing layer 102 which correspond to different ratios of the cross-sectional area of the plurality of cavities U of the polishing pad 100 on the backside surface BS of the polishing layer 102 to the orthogonal projection area of the polishing layer 102 are recited.

TABLE 1

| The ratio of the cross-sectional area of the plurality of cavities U on the backside surface BS of the polishing layer 102 to the orthogonal projection area of the polishing layer 102 (%) | The ratio of the contact area between the metal-containing layer 104 and the backside surface BS of the polishing layer 102 to the orthogonal projection area of the polishing layer 102 (%) |
|---|---|
| 1 | 102.02 |
| 2 | 104.08 |
| 5 | 110.53 |
| 10 | 122.22 |
| 20 | 150.00 |
| 30 | 185.71 |
| 40 | 233.33 |
| 50 | 300.00 |

From the results disclosed in Table 1 above, it can be seen that when the backside surface BS of the polishing layer 102 has the plurality of cavities U, the contact area between the metal-containing layer 104 and the backside surface BS of the polishing layer 102 is larger than the orthogonal projection area of the polishing layer 102. Further, from the results disclosed in Table 1 above, it can be seen that the contact area between the metal-containing layer 104 and the backside surface BS of the polishing layer 102 is increased as the proportion of the cross-sectional area of the plurality of cavities U on the backside surface BS of the polishing layer 102 to the orthogonal projection area of the polishing layer 102 is increased.

In the present embodiment, the metal-containing layer 104 has good thermal conductivity, and can conduct the contacted heat to the external environment to reduce insufficient planarization problem resulted from the softened polishing layer 102 or reduce polishing defects caused by the glazing surface of the polishing layer 102, due to high temperature. Whereby, the stability of the polishing process can be maintained. In one embodiment, the metal-containing layer 104 has a thermal conductivity greater than about 10 W/m·K (e.g., greater than about 30 W/m·K, 50 W/m·K, or 100 W/m·K, but the invention is not limited thereto), whereby the metal-containing layer 104 has good thermal conductivity, so that the heat generated by the friction in the polishing process can be more efficiently conducted to the external environment. In this embodiment, the material of the metal-containing layer 104 may include metal, alloy or metal-nonmetal compound. The metal is, for example, but not limited to: aluminum, copper, silver, gold, nickel, zinc, tin, titanium or chromium. The alloy is, for example, but not limited to: aluminum-copper alloy, copper-zinc alloy, copper-tin alloy, nickel-chromium alloy or titanium-aluminum alloy. The metal-nonmetal compound is, for example, but not limited to: aluminum-nitrogen compound, tantalumnitrogen compound, titanium-nitrogen compound or titanium-carbon compound. The thermal conductivity of the material of the conventional polishing layer 102 or the conventional adhesive layer 106 is typically less than about 1 W/m·K. Since the thermal conductivity of the metal-containing layer 104 is much higher than that of the polishing layer 102 or the adhesive layer 106, the heat generated by the friction in the polishing process is vertically conducted to the polishing platen to which the polishing pad 100 is fixed, and also is laterally conducted to region around the polishing pad 100 due to the high thermal conductivity of the metal-containing layer 104. As a result, the temperature of the polishing pad 100 can be decreased.

In the present embodiment, the polishing pad 100 includes the polishing layer 102 having the plurality of cavities U on the backside surface BS, and the metal-containing layer 104 disposed on the backside surface BS of the polishing layer 102 and filling into the plurality of cavities U, wherein the contact area between the metal-containing layer 104 and the backside surface BS of the polishing layer 102 is larger than the orthogonal projection area of the polishing layer 102. It should be noted that since the heat conduction efficiency is proportional to the heat dissipation area, compared to the polishing pad which has a polishing layer with a flat backside surface and a metal-containing layer on the polishing layer (i.e., the polishing layer does not have a plurality of cavities U, and the contact area between the metal-containing layer and the polishing layer is substantially equal to the orthogonal projection area of the polishing layer), the polishing pad 100 of the present embodiment in which the contact area between the metal-containing layer 104 and the polishing layer 102 is greater than the orthogonal projection area of the polishing layer 102 has the increased heat dissipation area of the metal-containing layer 104 so as to improve the heat conduction efficiency. In this way, during the polishing process, the heat generated by the friction can be efficiently conducted to the external environment via the metal-containing layer 104 to reduce the accumulation of heat in the polishing pad 100, whereby the degree of the temperature rise of the polishing pad 100 due to the friction is lowered, and the purpose of effectively decreasing the temperature of the polishing pad 100 is achieved.

In one embodiment, the polishing pad 100 may selectively include the adhesive layer 106 disposed below the metal-containing layer 104. That is, the metal-containing layer 104 is located between the adhesive layer 106 and the polishing layer 102. As shown in FIG. 1, the adhesive layer 106 fills up the plurality of recessed portions C and is in contact with the metal-containing layer 104, so that the contact area between the adhesive layer 106 and the metal-containing layer 104 is larger than the orthogonal projection area of the polishing layer 102. In one embodiment, the contact area between the adhesive layer 106 and the metal-containing layer 104 is greater than about 102% of the orthogonal projection area of the abrasive layer 102. It should be noted that since the adhesion is proportional to the contact area, compared to the polishing pad which has a polishing layer, a metal-containing layer with a flat backside surface on the polishing layer and an adhesive layer on the metal-containing layer (i.e., the metal-containing layer does not have a plurality of recessed portions C, and the contact area between the adhesive layer and the metal-containing layer is substantially equal to the orthogonal projection area of the polishing layer), the polishing pad 100 of the present embodiment in which the contact area between the adhesive layer 106 and the metal-containing layer 104 is greater than the orthogonal projection area of the polishing layer 102 has the increased contact area of the adhesive layer 106 so as to improve the adhesion. On the other hand, the metal-containing layer 104 of the polishing pad 100 reduces the degree of temperature rise during the polishing process, thereby the problem that the adhesive layer 106 deteriorates, deforms or decreases in adhesion due to high temperature is avoided, so as to maintain the stability of the polishing process.

Figure 2:
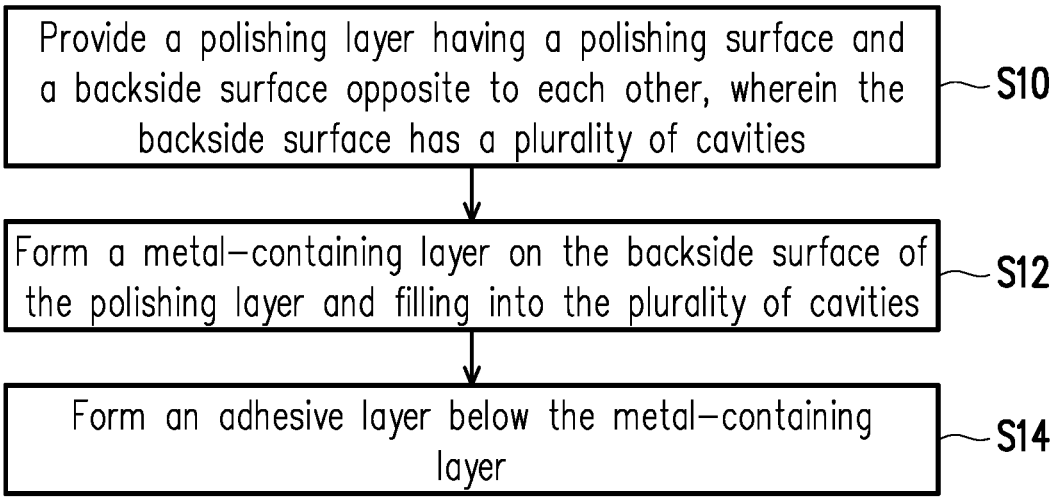
FIG. 2 is a flow chart of a method of manufacturing a polishing pad in accordance with an embodiment of the present invention.

Hereinafter, in order to more clearly describe the polishing pad 100 and its efficacy, a method of manufacturing the polishing pad 100 will be described with reference to FIG. 2. FIG. 2 is a flow chart showing a method of manufacturing a polishing layer according to an embodiment of the present invention.

First, referring to FIG. 2 and FIG. 1, in step S10, a polishing layer 102 is provided, wherein the polishing layer 102 has a polishing surface PS and a backside surface BS opposite to each other, and the backside surface BS has a plurality of cavities U. As described above, in the present embodiment, the polishing layer 102 may be a porous structure or a non-porous structure. In one embodiment in which the polishing layer 102 is a porous structure, the method of forming the polishing layer 102 may include the steps as followed. First, a semi-finished polishing layer is provided, wherein the semi-finished polishing layer includes a body layer having a porous structure and a skin layer having a non-porous structure, the skin layer is disposed on the surface of the body layer. The method of providing the semi-finished polishing layer may include, for example, molding the polymer material in a mold using an injection molding method or a compression molding method. The polymer material is the main material constituting the polishing layer 102 to be manufactured, and is, for example, polyester, polyether, polyurethane, polycarbonate, polyacrylate, polybutylene, polybutadiene, or other polymer material synthesized via a suitable thermosetting resin or a suitable thermoplastic resin, but the invention is not limited thereto. In detail, in this embodiment, during the process of curing the polymer material, the surface of the semi-finished polishing layer is in direct contact with the mold, thereby causing a slight difference between the portion of the semi-finished polishing layer adjacent to the surface thereof and the rest portion of the semi-finished polishing layer. The portion adjacent to the surface constitutes a skin layer having a non-porous structure, and the rest portion constitutes a body layer having a porous structure.

Next, the skin layer on the lower surface of the semi-finished polishing layer is removed to expose a portion of the body layer having the porous structure, thereby forming the polishing layer 102 with the plurality of cavities U on its backside surface BS. That is, in this embodiment, the plurality of cavities U of the polishing layer 102 may belong to part of the porous structure. The method of removing the skin layer may include, for example, performing mechanical cutting, chemical etching, laser processing, or abrasion.

When the polishing layer 102 is a porous structure, in an optional embodiment, the method of forming the polishing layer 102 may further include the step of removing the skin layer on the upper surface of the semi-finished polishing layer to expose another portion of the body layer having the porous structure. As such, in this embodiment, similar to the backside surface BS of the polishing layer 102, a plurality of cavities (not shown) are formed on the polishing surface PS of the polishing layer 102. The method of removing the skin layer may include, for example, performing mechanical cutting, chemical etching, laser processing, or abrasion.

On the other hand, in one embodiment in which the polishing layer 102 is a non-porous structure, the method of forming the polishing layer 102 may include the following steps. First, a semi-finished polishing layer having a non-porous structure is provided. The method of providing the semi-finished polishing layer having a non-porous structure, for example, may include molding the polymer material into a mold using an injection molding method or a compression molding method. The polymer material is the main material constituting the polishing layer 102 to be manufactured, and is, for example, polyester, polyether, polyurethane, polycarbonate, polyacrylate, polybutylene, polybutadiene, or other polymer material synthesized via a suitable thermosetting resin or a suitable thermoplastic resin, but the invention is not limited thereto. In this embodiment, during the process of curing the polymer material, the surface of the semi-finished polishing layer is in direct contact with the mold, whereby the portion of the semi-finished polishing layer adjacent to the surface thereof is slightly different from the rest portion of the semi-finished polishing layer. For example, in one embodiment, the rest portion of the semi-finished polishing layer is lighter in color than the portion of the semi-finished polishing layer adjacent to the surface.

Next, a portion of the lower surface of the semi-finished polishing layer is removed to form the polishing layer 102 with the plurality of cavities U on its backside surface BS. The method of removing a portion of the lower surface of the semi-finished polishing layer may include, for example, performing mechanical cutting, chemical etching, laser processing, or abrasion. That is, in this embodiment, the plurality of cavities U of the polishing layer 102 may include knife marks, etch marks, laser marks or wear marks formed in a process of mechanical cutting, chemical etching, laser processing or abrasion.

Next, referring again to FIG. 2 and FIG. 1, in step S12, a metal-containing layer 104 is formed on the backside surface BS of the polishing layer 102 and fills into the plurality of cavities U. As shown in FIG. 1, in the present embodiment, the metal-containing layer 104 conformally fills into the plurality of cavities U to form a plurality of recessed portions C. The method of forming the metal-containing layer 104 may include, for example, evaporation, spray coating, physical vapor deposition, chemical vapor deposition, or electroplating.

In one embodiment, optionally, the metal-containing layer 104 formed on the backside surface BS of the polishing layer 102 may soften the polishing layer 102 through a contact temperature. In the present embodiment, the contact temperature is adjusted depending on the polymer material characteristics of the polishing layer 102. In one embodiment, the contact temperature ranges, for example, from about 40° C. to about 100° C. In another one embodiment, the contact temperature is, for example, higher than the softening point of the polymer material used for forming the polishing layer 102 by 5° C. to 30° C. It is worth mentioning that the polishing layer 102 is softened by the contact temperature, so that the bonding force between the polishing layer 102 and the metal-containing layer 104 is enhanced.

In the present embodiment, the backside surface BS which is the surface of the polishing layer 102 in contact with the metal-containing layer 104 has the plurality of cavities U such that the area thereof is larger than the orthogonal projection area of the polishing layer 102. Accordingly, the contact area between the metal-containing layer 104 and the backside surface BS of the polishing layer 102 is larger than the orthogonal projection area of the polishing layer 102.

Thereafter, referring to FIG. 2 and FIG. 1 again, in step S14, an adhesive layer 106 is formed below the metal-containing layer 104. As shown in FIG. 1, in the present embodiment, the adhesive layer 106 fills up the plurality of recessed portions C. That is, in the present embodiment, the adhesive layer 106 is in contact with the metal-containing layer 104. The method of forming the adhesive layer 106 may include, for example, but not limited to: coating the adhesive material used for forming the adhesive layer 106 on the metal-containing layer 104, or adhering the adhesive layer 106 to the metal-containing layer 104 in its entirety. The method of coating the adhesive material on the metal-containing layer 104 may include, for example, but not limited to: blade coating, press coating, spray coating, or spin coating. The adhesive layer 106 is, for example, but not limited to: a carrier-free adhesive or a double-sided adhesive. The material of the adhesive layer 106 may include, for example, but not limited to: an acrylic-based adhesive, a silicone-based adhesive, a rubber-based adhesive, an epoxy-based adhesive, or a urethane-based adhesive.

In addition, in the present embodiment, the area of the backside surface BS of the polishing layer 102 is larger than the orthogonal projection area of the polishing layer 102, and the metal-containing layer 104 conformally fills into the plurality of cavities U of the backside surface BS of the polishing layer 102 to form the plurality of recessed portions C, so that the contact area between the adhesive layer 106 filling up the plurality of recessed portions C and the metal-containing layer 104 is larger than the orthogonal projection area of the polishing layer 102.

In the embodiment of FIG. 2, the method of manufacturing the polishing pad 100 includes the step S10 of forming the polishing layer 102, the step S12 of forming the metal-containing layer 104, and the step S14 of forming the adhesive layer 106, so that the formed polishing pad 100 is fixed to the polishing platen through the adhesive layer 106, but the invention is not limited thereto. In other embodiments, the method of manufacturing the polishing pad 100 may not include the step of forming the adhesive layer 106, and the formed polishing pad 100 is fixed to the polishing platen by means of adsorption (for example, vacuum adsorption).

In the embodiment of FIG. 1, the metal-containing layer 104 of the polishing pad 100 conformally fills into the plurality of cavities U to form the plurality of recessed portions C, but the present invention is not limited thereto. Hereinafter, a detailed description will be given with reference to FIG. 3.

Figure 3:
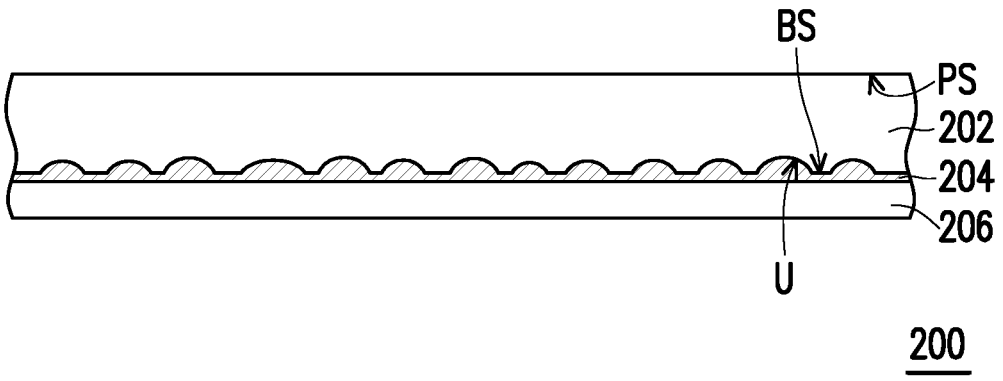
FIG. 3 is a schematic cross-sectional view of a polishing pad in accordance with another embodiment of the present invention.

FIG. 3 is a schematic cross-sectional view of a polishing pad in accordance with another embodiment of the present invention. Referring to FIG. 3 and FIG. 1, the polishing pad 200 of FIG. 3 is similar to the polishing pad 100 of FIG. 1, and therefore the same or similar elements are represented by the same or similar numerals, and the related descriptions thereof may refer to the descriptions above and are thus omitted here. In addition, a polishing layer 202 is the same as or similar to the corresponding one in the embodiment of FIG. 1 described above, and thus the related description is not described again. Hereinafter, the difference between the two embodiments will be described.

Referring to FIG. 3, in the present embodiment, the polishing pad 200 includes the polishing layer 202 and a metal-containing layer 204. In addition, in the present embodiment, the polishing pad 200 may selectively include an adhesive layer 206.

In the present embodiment, the metal-containing layer 204 is disposed on the backside surface BS of the polishing layer 202 and fills into the plurality of cavities U in the backside surface BS. In detail, as shown in FIG. 3, in the present embodiment, the metal-containing layer 204 fills up the plurality of cavities U. In the present embodiment, the backside surface BS is the surface of the polishing layer 202 in contact with the metal-containing layer 204 and the contact area of the backside surface BS of the polishing layer 202 is larger than the orthogonal projection area of the polishing layer 202, so the contact area between the metal-containing layer 204 and the backside surface BS of polishing layer 202 is greater than the orthogonal projection area of polishing layer 202. In one embodiment, the contact area between the metal-containing layer 204 and the backside surface BS of the polishing layer 202 is greater than about 102% of the orthogonal projection area of the polishing layer 202. In addition, as shown in FIG. 3, in the present embodiment, the lower surface of the metal-containing layer 204 is a substantially flat surface, so the area of the lower surface of the metal-containing layer 204 is substantially equal to the orthogonal projection area of the polishing layer 202.

In the present embodiment, the adhesive layer 206 is disposed below the metal-containing layer 204. That is, in the present embodiment, the metal-containing layer 204 is located between the adhesive layer 206 and the polishing layer 202. As shown in FIG. 3, in the present embodiment, the adhesive layer 206 is in contact with the metal-containing layer 204 and the lower surface of the metal-containing layer 204 is a substantially flat surface, so that the contact area between the adhesive layer 206 and the metal-containing layer 204 is substantially equal to the orthogonal projection area of the polishing layer 202.

In the present embodiment, the polishing pad 200 includes the polishing layer 202 having the plurality of cavities U on the backside surface BS, and the metal-containing layer 204 disposed on the backside surface BS of the polishing layer 202 and filling into the plurality of cavities U, wherein the contact area between the metal-containing layer 204 and the backside surface BS of the polishing layer 202 is larger than the orthogonal projection area of the polishing layer 202. It should be noted that since the heat conduction efficiency is proportional to the heat dissipation area, compared to the polishing pad which has a polishing layer with a flat backside surface and a metal-containing layer on the polishing layer (i.e., the polishing layer does not have a plurality of cavities U, and the contact area between the metal-containing layer and the polishing layer is substantially equal to the orthogonal projection area of the polishing layer), the polishing pad 200 of the present embodiment in which the contact area between the metal-containing layer 204 and the polishing layer 202 is greater than the orthogonal projection area of the polishing layer 202 has the increased heat dissipation area of the metal-containing layer 204 so as to improve the heat conduction efficiency. In this way, during the polishing process, the heat generated by the friction can be efficiently conducted to the external environment via the metal-containing layer 204 to reduce the accumulation of heat in the polishing pad 200, whereby the degree of the temperature rise of the polishing pad 200 due to the friction is lowered, and the purpose of effectively decreasing the temperature of the polishing pad 200 is achieved. On the other hand, in the case where the polishing pad 200 further includes the adhesive layer 206, the metal-containing layer 204 of the polishing pad 200 reduces the degree of temperature rise during the polishing process, thereby the problem that the adhesive layer 206 deteriorates, deforms or decreases in adhesion due to high temperature is avoided, so as to maintain the stability of the polishing process.

On the other hand, based on the contents of FIG. 3, FIG. 1 and FIG. 2, the method of manufacturing the polishing pad 200 of FIG. 3 is similar to the method of manufacturing the polishing pad 100 of FIG. 1, and the steps S10 of the two are the same, and will not be described again. Hereinafter, the difference between the two will be described.

Referring to FIG. 3 and FIG. 2, in step S12, a metal-containing layer 204 is formed on the backside surface BS of the polishing layer 202 and fills into the plurality of cavities U. As shown in FIG. 3, in the present embodiment, the metal-containing layer 204 fills up the plurality of cavities U. That is, in the present embodiment, the metal-containing layer 204 is in contact with the polishing layer 202. The method of forming the metal-containing layer 204 may include, for example, evaporation, spray coating, physical vapor deposition, chemical vapor deposition, or electroplating.

In the present embodiment, the backside surface BS which is the surface of the polishing layer 202 in contact with the metal-containing layer 204 has the plurality of cavities U such that the area thereof is larger than the orthogonal projection area of the polishing layer 202. Accordingly, the contact area between the metal-containing layer 204 and the backside surface BS of the polishing layer 202 is greater than the orthogonal projection area of the polishing layer 202.

Next, referring again to FIG. 3 and FIG. 2, in step S14, an adhesive layer 206 is formed below the metal-containing layer 204. In the present embodiment, the adhesive layer 206 is formed on the lower surface of the metal-containing layer 204. The method of forming the adhesive layer 206 may include, for example, but not limited to: coating the adhesive material used for forming the adhesive layer 206 on the metal-containing layer 204, or adhering the adhesive layer 206 to the metal-containing layer 204 in its entirety. The method of coating the adhesive material to the metal-containing layer 204 may include, for example, but not limited to: blade coating, press coating, spray coating, or spin coating. The adhesive layer 206 is, for example, but not limited to: a carrier-free adhesive or a double-sided adhesive. The material of the adhesive layer 206 may include, for example, but not limited to: an acrylic-based adhesive, a silicone-based adhesive, a rubber-based adhesive, an epoxy-based adhesive, or a urethane-based adhesive.

Further, in the present embodiment, the adhesive layer 206 is in contact with the lower surface of the metal-containing layer 204. As shown in FIG. 3, in the present embodiment, the lower surface of the metal-containing layer 204 is a substantially flat surface, so that the contact area between the adhesive layer 206 and the metal-containing layer 204 is substantially equal to the orthogonal projection area of the polishing layer 202.

In the embodiment of FIG. 2, the method of manufacturing the polishing pad 200 includes the step S10 of forming the polishing layer 202, the step S12 of forming the metal-containing layer 204, and the step S14 of forming the adhesive layer 206, so that the formed polishing pad 200 is fixed to the polishing platen through the adhesive layer 206, but the invention is not limited thereto. In other embodiments, the method of manufacturing the polishing pad 200 may not include the step of forming the adhesive layer 206, and the formed polishing pad 200 is fixed to the polishing platen by means of adsorption (for example, vacuum adsorption).

Figure 4:
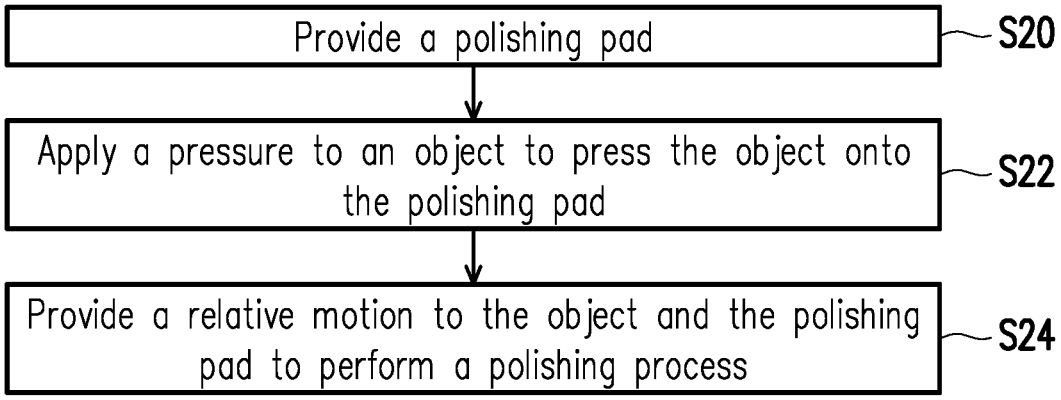
FIG. 4 is a flow chart of a polishing method in accordance with an embodiment of the present invention.

FIG. 4 is a flow chart of a polishing method in accordance with an embodiment of the present invention. This polishing method is suitable for polishing objects. Specifically, the polishing method according to embodiments of the invention may be applied to polishing processes for manufacturing industrial devices. For example, it may be applied to devices in the electronic industry, such as devices of semiconductors, integrated circuits, micro electro-mechanics, energy conversion, communication, optics, storage disks and displays. The objects used for manufacturing the devices may include semiconductor wafers, Group III-V wafers, storage device carriers, ceramic substrates, polymer substrates and glass substrates, but the invention is not limited thereto.

Referring to FIG. 4, first, in step S20, a polishing pad is provided. In detail, in this embodiment, the polishing pad may be any type of polishing pads as described in the foregoing embodiments, e.g., polishing pad 100 or 200. Relevant descriptions of the polishing pads 100 and 200 have been detailed above and thus will not be repeated here.

Next, in step S22, a pressure is applied to an object. Thereby, the object is pressed onto the polishing pad and is in contact with the polishing pad. In detail, as previously described, the object is in contact with the polishing surface PS of the polishing layer 102 or 202. In addition, the method of applying pressure to the object is performed by using, for example, a carrier capable of holding the object.

Thereafter, in step S24, a relative motion is provided to the object and the polishing pad, so as to perform a polishing process on the object using the polishing pad and achieve the purpose of planarization. In detail, the method for providing the relative motion to the object and the polishing pad is, for example, rotating the polishing pad fixed on a polishing platen via rotation of the polishing platen.

When the polishing pad of the present invention is applied to the above-described polishing step, the rising temperature due to friction can be decreased using the polishing pad of the present invention in which has the metal-containing layer, as compared with a conventional polishing pad having a similar structure but not including a metal-containing layer. In one embodiment, the temperature of the polishing pad of the present invention can be decreased by, for example, about 1° C. to about 20° C., but the invention is not limited thereto. Further, the thickness of the metal-containing layer in each of the above embodiments can be adjusted depending on the depth of the cavities U and the required heat dissipation efficiency. In one embodiment, the thickness of the metal-containing layer ranges, for example, from about 5 μm to about 200 μm, but the invention is not limited thereto.

In addition, the polishing pads of the above embodiments are illustrated and described in a single layer structure including a polishing layer, but the scope of the invention is not limited thereto. The polishing pad of the present invention may additionally include one or more underlayers disposed underneath the structures of the above-described embodiments to have a two-layer or multi-layer structure. The underlayer is, for example, a layer having a lower or higher hardness than the polishing layer.

In summary, the advantages of the polishing pad of the present invention have been described in detail in the above embodiments. In addition, for certain polishing processes, there is still a need to address the problem of moisture permeating through the polishing layer. The metal-containing layer included in the polishing pad of the present invention can reduce the permeation of moisture through the polishing layer due to the low moisture permeability, so as to prevent the adhesion of the adhesive layer under the polishing layer from being affected, or to avoid the fixed ability of the polishing pad absorbed onto the polishing platen from being disturbed. Accordingly, the polishing pad has better polishing stability.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A polishing pad, comprising:

a polishing layer having a polishing surface and a backside surface opposite to each other, wherein the backside surface has a plurality of cavities; and a metal-containing layer disposed on the backside surface of the polishing layer and filling into the plurality of cavities, wherein a first contact area is between the metal-containing layer and the backside surface of the polishing layer, and the first contact area is larger than an orthogonal projection area of the polishing layer, and wherein the metal-containing layer conformally fills into the plurality of cavities to form a plurality of recessed portions, such that the metal-containing layer has a surface profile conforming to the contour of the backside surface of the polishing layer.

2. The polishing pad of claim 1, wherein a ratio of a cross-sectional area of the plurality of cavities on the backside surface to the orthogonal projection area of the polishing layer is greater than 1%.

3. The polishing pad of claim 1, wherein the first contact area is greater than 102% of an orthogonal projection area of the polishing layer.

4. The polishing pad of claim 1, wherein the metal-containing layer has a thermal conductivity greater than 10 W/m·K.

5. The polishing pad according to claim 1, wherein a material of e metal-containing layer comprises metal, alloy or metal-nonmetal compound.

6. The polishing pad of claim 1, further comprising an adhesive layer disposed below the metal-containing layer, a second contact area is between the adhesive layer and the metal-containing layer, and the second contact area is larger than the orthogonal projection area of the polishing layer.

7. The polishing pad of claim 6, wherein the adhesive layer fills up the plurality of recessed portions.

8. The polishing pad of claim 1, wherein the polishing layer is a porous structure, and the plurality of cavities are part of the porous structure.

9. The polishing pad of claim 1, wherein the polishing layer is a non-porous structure, and the plurality of cavities comprise knife marks, etch marks, laser marks or wear marks.

10. A polishing method, for polishing an object, comprising:

providing a polishing pad according to claim 1;

applying pressure to the object to press onto the polishing pad; and providing a relative motion to the object and the polishing pad to perform a polishing process.

11. A polishing pad, comprising:

a polishing layer having a polishing surface and a backside surface opposite to each other, wherein the backside surface has a plurality of cavities;

a metal-containing layer disposed on the backside surface of the polishing layer and filling into the plurality of cavities, wherein a first contact area is between the metal-containing layer and the backside surface of the polishing layer, and the first contact area is larger than an orthogonal projection area of the polishing layer; and an adhesive layer disposed below the metal-containing layer, wherein a second contact area is between the adhesive layer and the metal-containing layer, and the second contact area is substantially equal to the orthogonal projection area of the polishing layer.

12. The polishing pad of claim 11, wherein the metal-containing layer fills up the plurality of cavities.

13. The polishing pad of claim 11, wherein a ratio of a cross-sectional area of the plurality of cavities on the backside surface to the orthogonal projection area of the polishing layer is greater than 1%.

14. The polishing pad of claim 11, wherein the first contact area is greater than 102% of an orthogonal projection area of the polishing layer.

15. The polishing pad of claim 11, wherein the metal-containing layer has a thermal conductivity greater than 10 W/m·K.

16. The polishing pad of claim 11, wherein a material of the metal-containing layer comprises metal, alloy or metal-nonmetal compound.

17. The polishing pad of claim 11, wherein the polishing layer is a porous structure, and the plurality of cavities are part of the porous structure.

18. The polishing pad of claim 11, wherein the polishing layer is a non-porous structure, and the plurality of cavities comprise knife marks, etch marks, laser marks or wear marks.

* * * * *